United States Patent [19]

Fischer

[11] 4,100,638

[45] Jul. 18, 1978

[54] FORGING MACHINE

[75] Inventor: Donald A. Fischer, Strongsville, Ohio

[73] Assignee: Kalt Manufacturing Company, North Ridgeville, Ohio

[21] Appl. No.: 779,348

[22] Filed: Mar. 21, 1977

[51] Int. Cl.[2] ..... B21K 1/44; B21J 9/18; B21J 13/04

[52] U.S. Cl. ..... 10/15; 72/450; 72/455; 308/3 A

[58] Field of Search ..... 10/11 R, 11 T, 11 G, 10/12 R, 12 T, 13, 15, 72 R, 72 T, 76 R, 76 T, 78, 9, 21; 72/450, 453.09, 455; 308/3 A, 6 C

[56] References Cited

U.S. PATENT DOCUMENTS

| | | | |
|---|---|---|---|
| 605,167 | 6/1898 | Kingsley | 72/421 |
| 1,927,407 | 9/1933 | Kessler | 72/455 X |
| 2,205,585 | 6/1940 | Wilcox | 10/15 |
| 2,719,761 | 10/1955 | Bonnafe | 308/3 A |
| 2,918,333 | 12/1959 | Friedman | 10/15 |
| 3,511,545 | 5/1970 | Brettrager | 308/6 C |
| 3,559,446 | 2/1971 | Dom et al. | 10/12 T X |
| 3,696,657 | 10/1972 | Maytag | 72/450 |
| 3,907,385 | 9/1975 | Bartenstein | 308/3 A |

FOREIGN PATENT DOCUMENTS

| | | | |
|---|---|---|---|
| 712,382 | 6/1965 | Canada | 72/455 |

*Primary Examiner*—E. M. Combs

*Attorney, Agent, or Firm*—Watts, Hoffmann, Fisher & Heinke Co.

[57] ABSTRACT

A machine for forging the leading end of a metal screw blank comprising two pairs of complementary dies, one die of each pair of which is stationary and the other movable to and from the stationary die. The stationary dies are supported on opposite sides of a stationary die support and the movable dies on discrete movable die supports at opposite sides of the stationary die support. The movable die supports are connected to form a movable die assembly, are supported by linear ball bearings on cylindrical ways and are reciprocated as a unit by a pitman connected to a crankshaft by roller bearings, thus providing for the production of a forged blank upon each 180° rotation of the crankshaft. The movable die supports are adjustable relative to the stationary die support and the roller bearings have preload adjustments that make it possible to maintain a precise clearance between the respective dies of each pair in their closed position within one hundred twenty seven thousandths of a millimeter (0.127mm) or five-thousandths of an inch (0.005 inch) or less thus prolonging die life and allowing for the use of carbide dies.

The die carriers and the cylindrical ways for the movable die assembly are removable from the machine as a unit for purposes of maintenance, replacement, etc.

11 Claims, 6 Drawing Figures

FORGING MACHINE

BACKGROUND OF THE INVENTION

1. Field of the Invention

The invention relates to forging machines wherein complementary dies are reciprocated relative to one another by apparatus including a rotatable crankshaft connected to a movable die carrier by a pitman or connecting rod.

2. Description of the Prior Art

Forging machines including relatively reciprocal die carriers supports are known but are incapable of maintaining precise close clearances between the dies in their closed position thus prohibiting the use of carbide dies.

SUMMARY OF THE INVENTION

The invention provides a novel and improved forging machine comprising relatively reciprocable die supports for complementary forging dies that will maintain a relatively small fixed closed predetermined clearance of about one hundred twenty seven thousandths of a millimeter (0.127mm) or five-thousandths of an inch (0.005) and less between dies employed therein for long periods of machine operation, thus permitting the use of carbide dies which are relatively brittle and readily damaged by contact with one another.

The invention also provides a novel and improved high speed forging machine comprising a stationary die support for supporting oppositely facing stationary dies of pairs of complimentary dies or die sets the movable dies of which are carried at opposite sides of the stationary die support by a crankshaft reciprocated movable die support assembly such that a discrete forging operation is performed for each 180° rotation of the crankshaft.

The invention further provides a forging machine of the character referred to in the preceding paragraph comprising relatively reciprocable die supports for complementary pairs of forging dies in which the die supports are removable as a unit thus reducing the down time of the machine for maintenance and related purposes.

Other features and advantages of the invention will be apparent from the following description of the preferred embodiment which is merely illustrative of the invention.

DESCRIPTION OF THE PREFERRED EMBODIMENT

Figure 1:
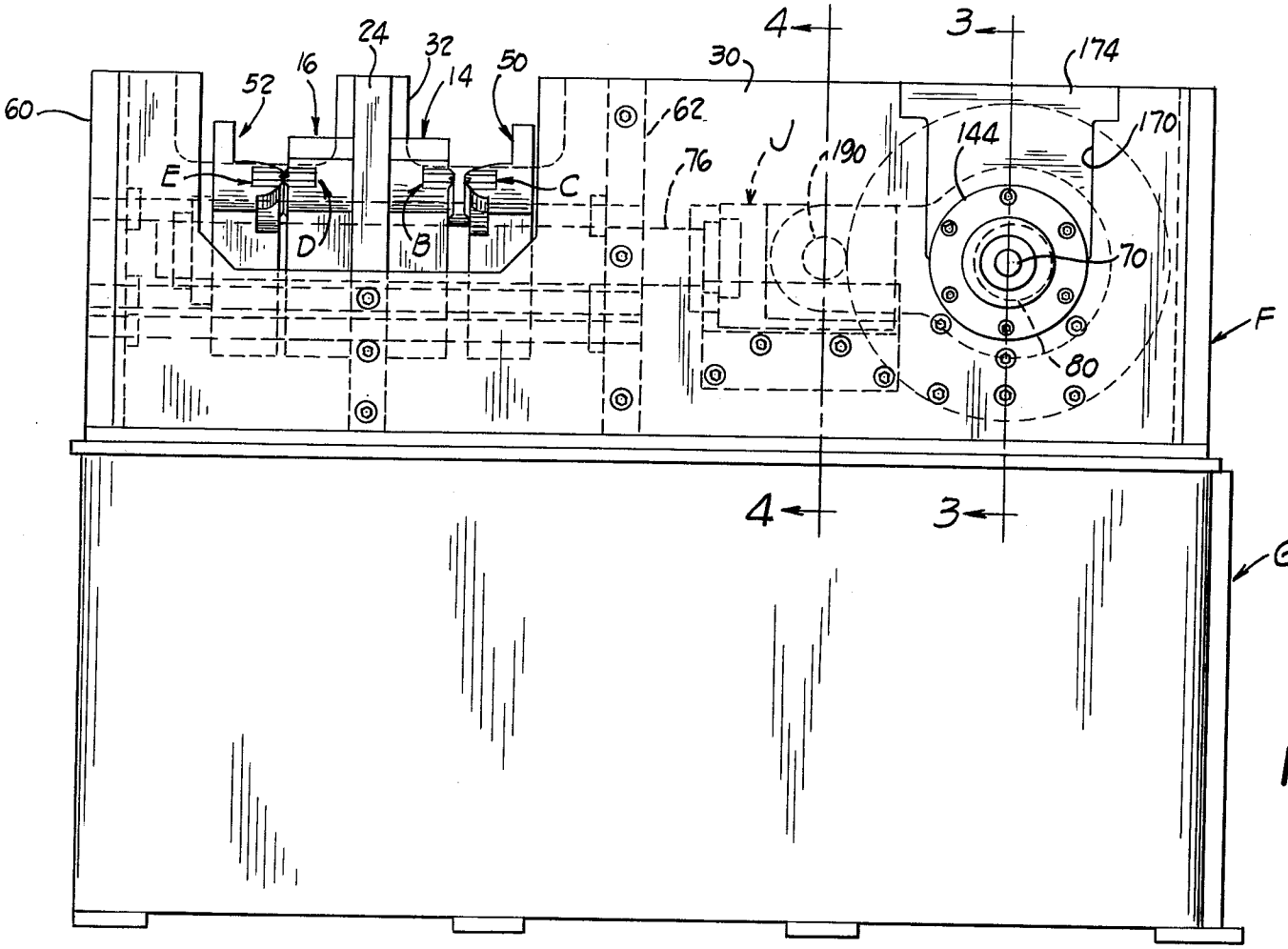
FIG. 1 is a front elevational view of a forging machine embodying the present invention.

The invention may be embodied in forging machines for performing various operations but is especially suited for use in the production of threaded fastener blanks and/or threaded fasteners and is herein depicted as incorporated in a forging machine for forging the leading end of a thread fastener blank.

The examplary machine shown in the drawings and designated generally by the reference character A, and hereinafter described in detail, is provided with complementary pairs of carbide dies or die sets B,C, and D,E for cold forging points on fastener blanks used to produce thread forming threaded fasteners. The complementary dies of each die set are similar to the dies shown in copending application Ser. No. 742,631 Filed Nov. 17, 1976, entitled Drill Screw, and Method, the disclosure of which is incorporated herein by reference. The fastener blanks produced by the depicted forging machine A are similar to the blanks disclosed in application Ser. No. 742,631.

Figure 2:
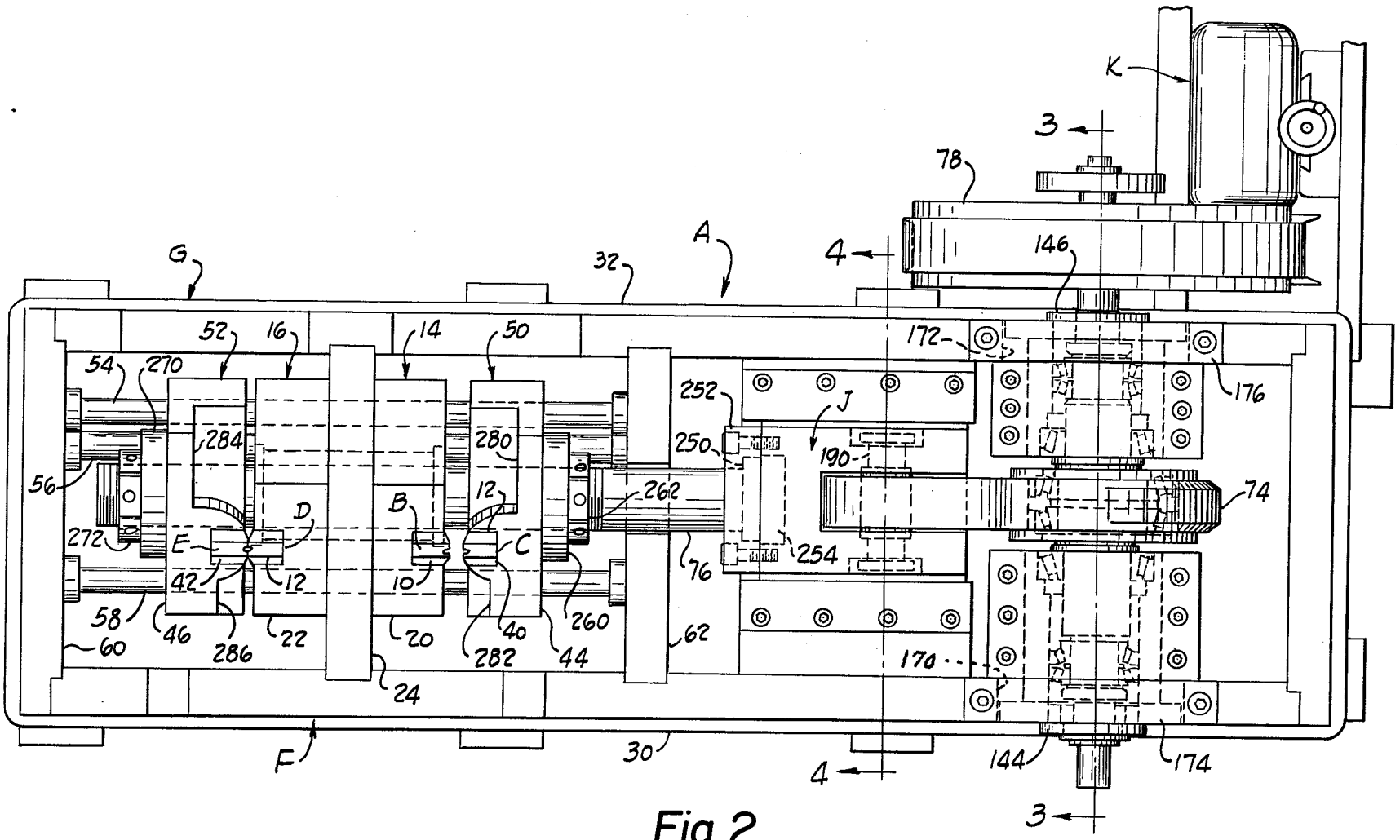
FIG. 2 is a plan view of the machine shown in FIG. 1.
Figure 3:
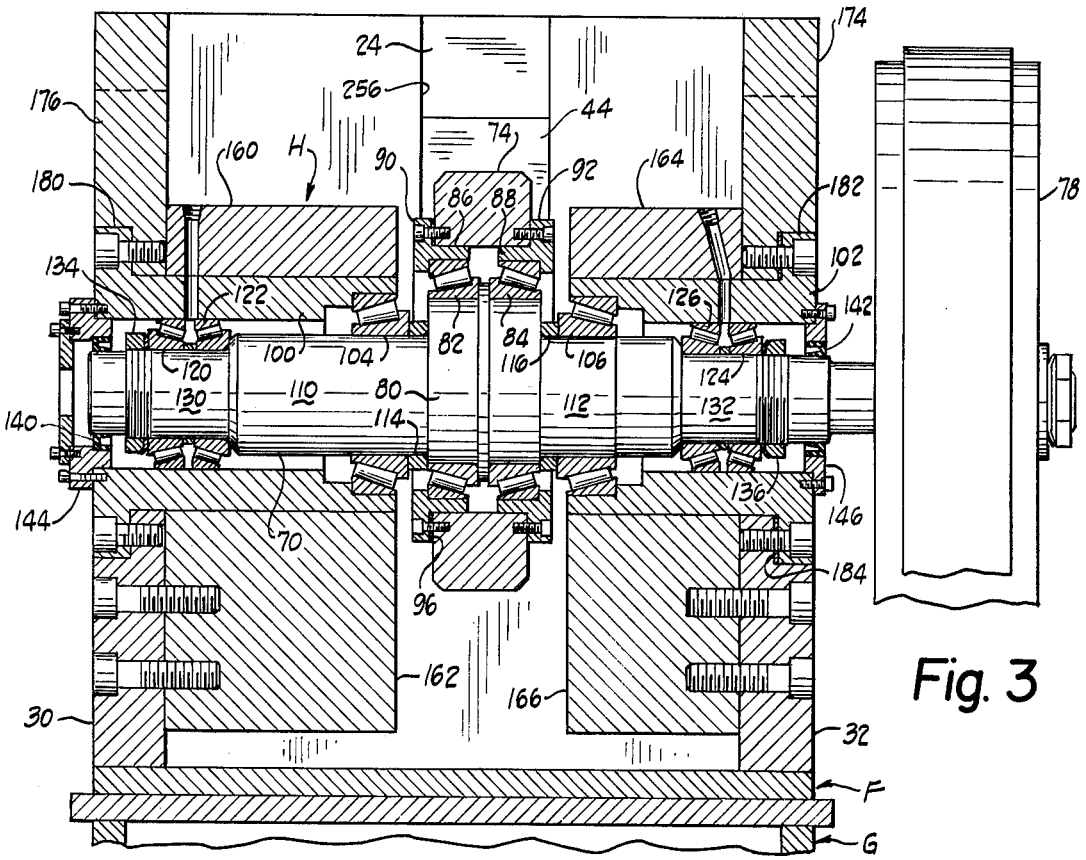
FIG. 3 is a sectional view, with parts in elevation, approximately on the line 3—3 of FIGS. 1 and 2.
Figure 4:
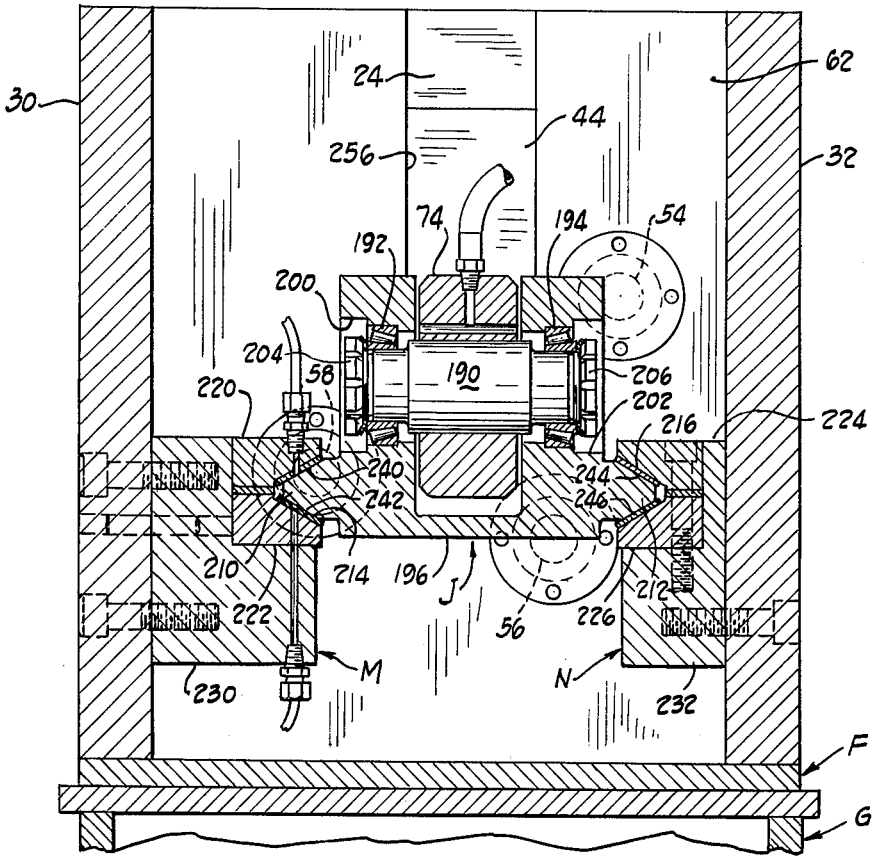
FIG. 4 is a sectional view, with part in elevation, approximately on the line 4—4 of FIGS. 1 and 2.

The dies or die set B,D are carried in fabricated die insert holders 10,12 removably connected to and forming a part of right and left hand stationary platen assemblies 14,16 as the machine is viewed in FIGS. 1 and 2. The platen assemblies 14,16 include right and left hand stationary platens 20,22 removably connected to an inside divider plate 24 which in turn is removably connected by socket head cap screws to front and rear vertical side plates 30,32 of a fabricated frame assembly F. The frame F is supported on a fabricated base assembly G. The die insert holders 10,12 are located in suitable apertures in oppositely facing sides of the stationary platens 20,22, respectively, and are normally retained therein by flat pointed socket set screws.

Figure 5:
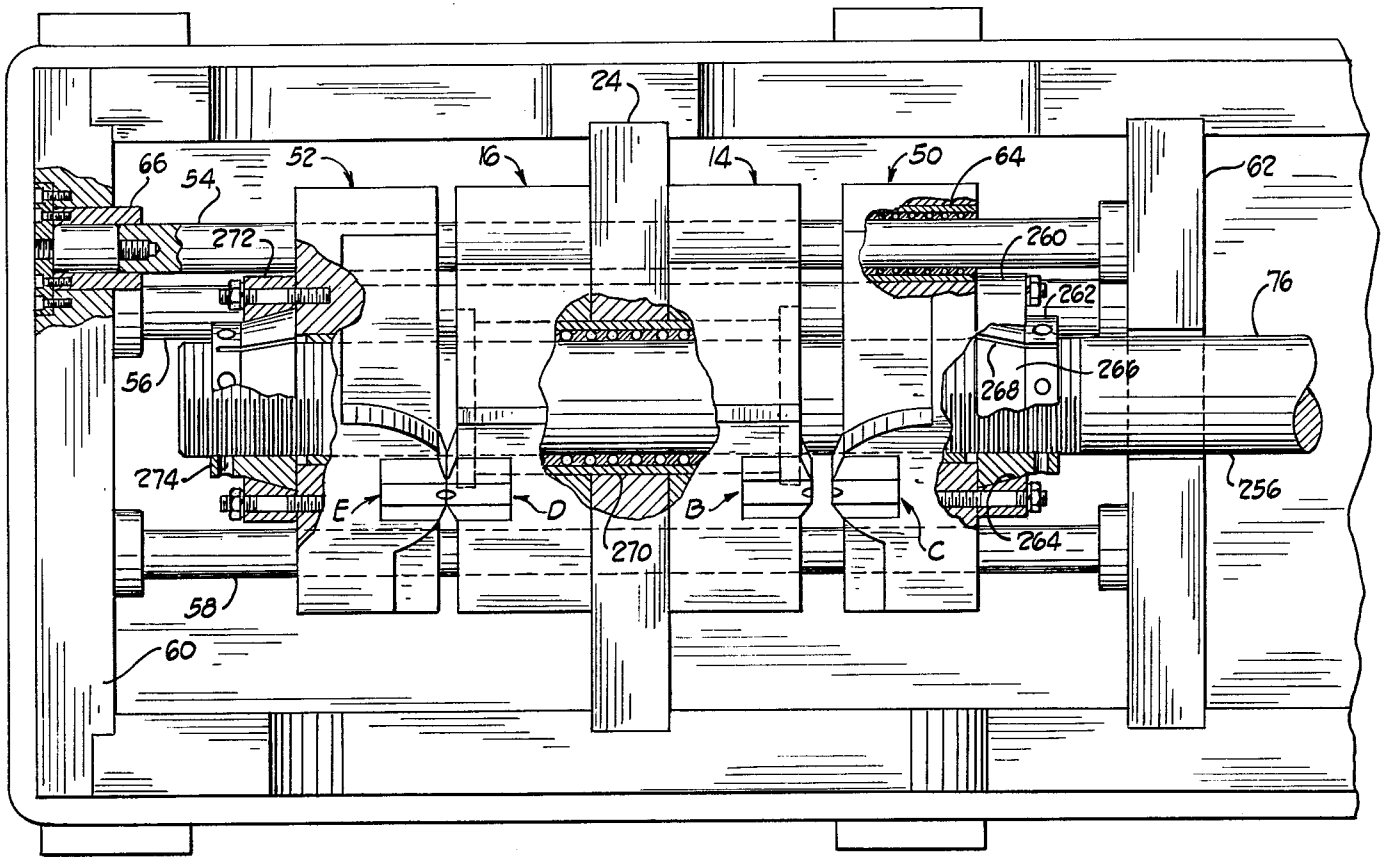
FIG. 5 is an enlarged view, with parts broken away and in section, of a portion of FIG. 2.
Figure 6:
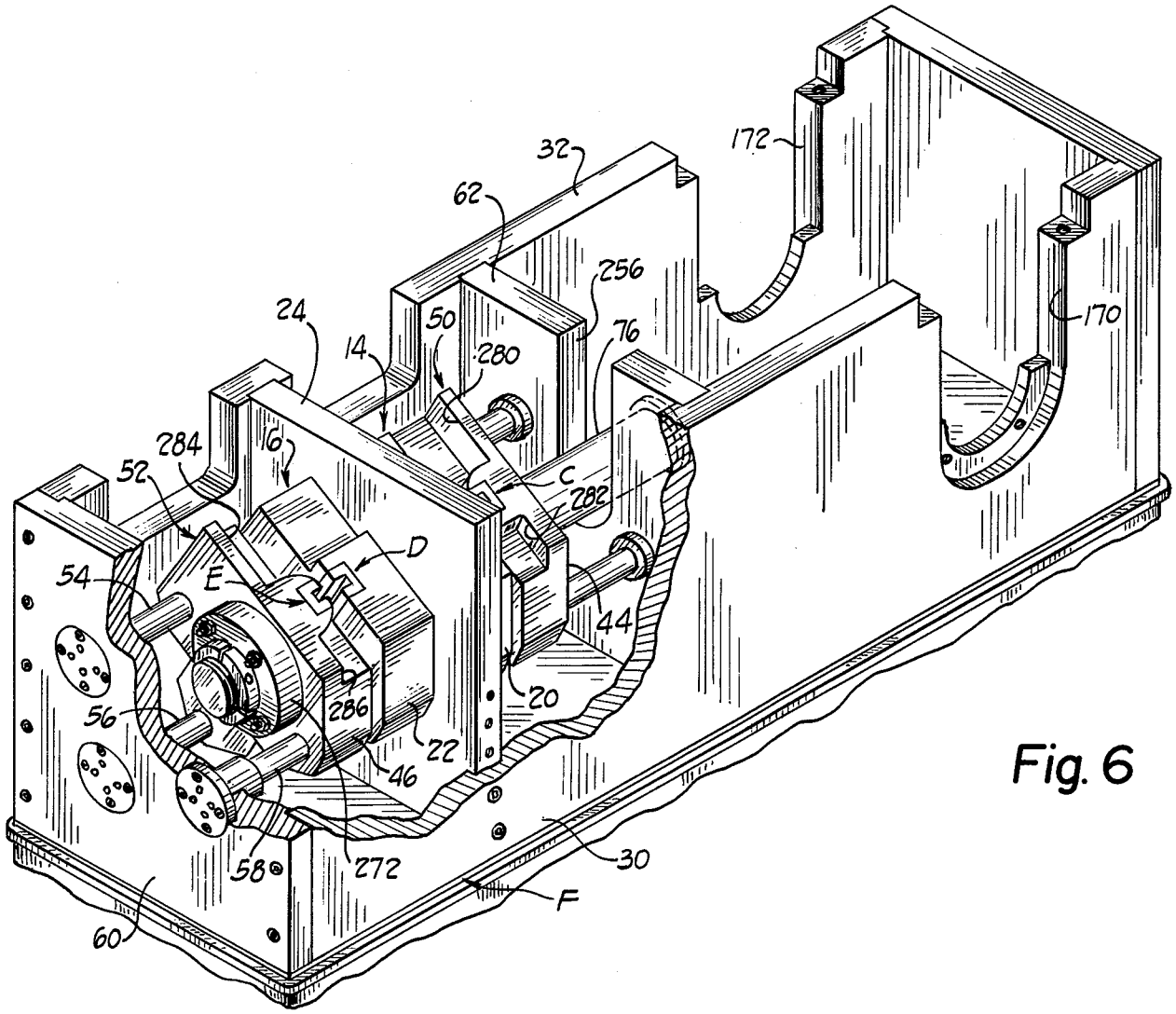
FIG. 6 is a perspective view, with parts omitted, of the machine.

The dies C,E are carried in die insert holders 40,42 similar to the die insert holders 10, 12. The die insert holders 40,42 are removably positioned in suitable apertures in right and left hand movable platens 44,46 forming parts of right and left hand movable ram or platen assemblies 50,52 located at opposite sides of the stationary platen assemblies 14,16. The movable ram assemblies 50,52 are slidably supported on hardend and ground cylindrical rod or shaft ways 54, 56, 58 by linear type ball bearings, designated generally as 64 and only one of which is shown in FIG. 5. Opposite ends of the shafts 54, 56, 58 stop short of the left hand end plate 60 of the frame assembly F and a second inside frame divider plate 62 and are fixedly but detachably connected to the plates 60,62 by collar or sleeve members, such as, the member 66 shown in FIG. 5, detachably connected to the plates 60,62.

The dies C, E of the movable platen assemblies 50, 52 are on the sides thereof facing the stationary platen assemblies 14,16 and the movable platen assemblies 50,52 are moved as a unit to reciprocate the dies C, E carried thereby to and from the stationary dies B, D, respectively, to point two fastener blanks upon each complete reciprocation of the movable platen assemblies, one by each pair of dies B, C and D E. The movable platen assemblies 50, 52 are reciprocated by a crankshaft 70 forming a part of a crankshaft assembly H. The crankshaft 70 is connected to a slidable crosshead or ram assembly J by a pitman 74. The ram assembly J is in turn connected to the right hand end of a movable platen assembly operating shaft 76 to which the movable platen assemblies 50, 52 are adjustably fixed. The crankshaft 70 is driven from a variable speed drive unit K through a belt drive the driven pully 78 of which is keyed to the rear end of the shaft 70.

The pitman 74 is connected to an eccentric part 80, of the crankshaft 70 by a pair of opposed tapered roller bearings 82, 84 the outer races of which are carried by annular members 86, 88 connected by socket head cap screws to the pitman 74. The members 86, 88 include annular flange parts 90, 92 bolted to the pitman 74 and sleeve parts extending into an annular opening 94 in the pitman 74 through which the crankshaft extends. A shim pack 96 is employed between one or both of the annular flange parts of members 86, 88 for adjusting the bearings 82, 84, which bearings are preferably preloaded a desired amount.

The crank shaft assembly H includes a pair of sleeve or tubular members 100, 102 supported in the frame assembly and extending inwardly from the front and rear plates 30,32 thereof to a point close to but spaced from opposite sides of the pitman 74. The front and rear ends of the crankshaft 70 are rotatably supported by tapered roller bearings including bearings 104, 106, the outer races of which bearing 104, 106 are fixed in counterbores in the inner ends of the members 100, 102 and the outer races on intermediate diameter parts 10, 112, respectively, of the crankshaft. The inner races of the bearings 104, 106 abut against ring-like spacers 14, 116 on the parts 110, 112 of the crankshaft which spacers in turn abut against the front and rear sides of the eccentric 80 of the crankshaft. In addition to the bearings 104, 106 the front and rear end of the crankshaft 70 are supported in the members 100, 102 outwardly of the bearings 104, 106 by pairs of opposed tapered roller bearings 120, 122 and 124, 126 located on reduced diameter sections 130, 132 of the crankshaft 70. The inner races of the inboard bearings 122, 126 abut shoulders on the crankshaft formed by the reduced diameter parts 130, 132 thereof and the inner races of the outboard bearings 120, 124 are adjustable on the crankshaft by adjusting nuts 134, 136 threaded on the crankshaft outwardly of the bearings 120, 124, respectively. The pairs of bearings 120, 122 and 124, 126 are preferably preloaded by the adjusting nuts 134, 136, respectively. Suitable seals 140, 142, are interposed between parts of the crankshaft 70 outwardly of the bearing adjusting nuts 134, 136 and annular members 144, 146 connected to the outer ends of the members 100, 102 by socket head cap screws.

The crankshaft assembly H includes front and rear pairs of rectangular or block-like members 160, 162 and 164, 166 having semicircular apertures in the sides of the members facing one another and forming cylindrical apertures in which the inboard ends of the members 100, 102 are supported. The members 160, 162 and 164, 166 of each pair are clamped together about the members 100, 102 by socket head cap screws and the lower members 162, 166 of each pair are connected to the front and rear side plates 30, 32 of the frame assembly F against which the members abut by dowel pins and further socket head cap screws.

The front and rear side plates 30, 32 of the frame assembly F have upwardly opening apertures 170, 172 with semicircular lower ends into which the assembled crankshaft assembly H can be dropped during assembly of the machine. The upper ends of the apertures are closed by guillotine-like members 174, 176 fitted therein and retained within the openings 170, 172 by socket head cap screws. The lower end of the members 174, 176 have semicircular apertures therein within which apertures the upper halves of the members 100, 102 are received. The outer ends of the members 100, 102 are provided with flanges 180, 182, respectively, which flanges are received in counterbores in the adjacent parts of the front and rear sides of the frame assembly F including the members 174, 176. Socket head cap screws inserted through suitable apertures in the flange parts 180, 182 of the members 100, 102 secure the members 100, 102 to the frame assembly F. A shim pack 184 interposed between the flange parts of one or both of the members 100, 102 and the adjacent frame assembly member provides means for adjusting and preloading the inward bearings 104, 106 of the crankshaft assembly H.

The left hand end of the pitman 74 is connected to a short shaft or wrist pin 190 extending therethrough and rotatably supported by tapered roller bearings 192, 194 in a member 196 forming part of the crosshead or ram assembly J. The inner races of the bearings 192, 194 engage reduced diameter end of the wrist pin 190 and the outer races thereof are recessed in counterbores 200, 202 in opposite ends of the aperture in the crosshead member 196 into which the ends of the wrist pin 190 extend. Nuts 204, 206 threaded onto the outer end of wrist pin 190 provides means for adjusting and preloading the bearings 192, 194.

The member 196 of the ram assembly J has oppositely projecting side flanges 210, 212 V-shape in cross section which are slidably received in V-shape grooves or ways 214, 216 provided by front and rear way assemblies designated generally by the reference characters M, N, respectively. The way assemblies M, N comprise pairs of way members 220, 222 and 224, 226, respectively, connected to members 230, 232, respectively, by socket head cap screws which members 230, 232 are in turn connected to the front and rear side plates 30, 32 of the frame assemblies F by suitable dowel pins and socket head cap screws. The pair of members 220, 222 are separated by a shim or shims 234 and the pair of members 224, 226 by a shim or shims 236. The shims 234, 236 provide means for adjusting the ways 214, 216. Opposed faces of both ways are faced by "Turcite" members 240, 242 and 244, 246, respectively, to reduce friction. The right hand end of the movable platen actuating shaft 76 is provided with an annular flange 250 secured to the left hand end of the ram member 196 by an annular member 252 slidable on the shaft 76 and secured to the member 196 by socket head cap screws. A hardened plate 254 located in a recess in the left hand end of the member 196 is interposed therebetween and the right hand end of the member 76. From the ram member 196 the shaft 76 extends towards the left through a slot 256 in the inside divider plate 62. The slot 256 opens into the top of the divider plate. The fact that the way members 220, 222 are removable facilitates removal of the ram J and adjustment of its supporting ways.

The right hand movable platen 44 of the right hand movable platen assembly 50 is supported on the shaft 76 which extends therethrough and is connected thereto for adjustment lengthwise of the shaft 76 by an annular adjustment ring retainer or member 260 and a platen assembly adjustment ring 262 threaded onto the shaft 76. The adjustment ring retainer 260 is connected to the platen 44 by studs and nuts and its internal diameter 264 is tapered with its enlarged end adjacent the platen to receive a complementarily tapered part 266 on the left hand end of the adjustment ring 262. The adjusting ring 262 extends to the right of the member 260 where it is provided with a plurality of cylindrical radial apertures facilitating rotation thereof on the shaft 76. The adjusting ring 262 is provided with a plurality of slots 268 in its left hand end which extend almost through its right hand end to divide its tapered left hand end into flexible sections which can be securely clamped by the ring retainer 260 in tight engagement with the shaft 76 to secure the platen assembly 50 in adjusted position on the shaft 76 and locate it in a precise position relative to the platen assembly 14 and in turn to precisely adjust the relative closing position of the dies D, E.

To the left of the threaded section of the shaft 76 upon which the adjusting ring 262 is threaded the shaft is of reduced diameter, is preferably hardened and ground and extends through a linear type ball bushing 270 in the stationary platen assembly 14. The left hand movable platen assembly 52 is connected to the left hand end of the shaft 76 for adjustment lengthwise thereof in a manner similar to that in which the platen assembly 50 is connected to the shaft 76 by an adjustment ring retainer 272 similar to the retainer member 260 and an adjusting ring 274 similar to the ring 262.

The machine work area is inclined at a 30° angle to the horizontal as clearly indicated in the drawings to facilitate feeding of work blanks to the machine. The forged work blanks drop through the machine and exit from the base thereof through suitable chute means.

The stationary dies B, D of the respective die sets project slightly from the right and left hand sides of the platens 44, 46, respectively, which sides in the machine depicted are flat. The movable platens 20, 22 which carry the dies C, E, respectively, are generally similar to the platens 20, 22 but the top or upper parts thereof are cut away at opposite sides of the die holders as at 280, 282 and 284, 286, respectively, to better accommodate blank feeders, not shown.

One of the features of the present design is that the stationary platen assemblies 14, 16 and the dividing plate 24 to which they are attached, the movable platen assemblies 50, 52 and their cylindrical ways 54, 56, 58 upon which they are supported, and the movable platen operating shaft 76 can be removed from the other parts of the machine as a unit for maintenance and/or replacement purposes. This is readily accomplished by removing the cap screws attaching the divider plate 24 to the front and rear frame plates 30, 32, removing the sleeve members connecting the shafts or rods 54, 56, 58 from the end plate 60 and the divider plate 62, disconnecting the shaft 76 from the members 196 of the ram J by unbolting the ring members 252 therefrom and lifting the then remaining assembled parts from the frame F through the open top thereof.

From the foregoing description of the depicted forging machine it will be apparent that a novel and improved forging machine has been provided which is capable of performing precise work. The tooling is precisely mounted and supported in platens that are precisely movable relative to one another. The various bearing adjustments provide for precise operation of the movable parts without looseness or play, etc., thus providing for the use of long lasting carbide dies. One unique innovation is that the crankshaft produces two work strokes or forging operations for every rotation of the shaft, spaced 180° apart and in turn two forged blanks for every rotation of the crankshaft.

While the preferred embodiment of the invention has been shown and described in considerable detail it is to be understood that the invention is not limited to the constructions shown and may be otherwise embodied.

What is claimed is:

1. A forging machine comprising a stationary frame, a stationary die support incorporated in or fixed with respect to said frame, a second die support, a crankshaft rotatably supported in said frame by adjustable tapered roller bearings, means for rotating said crankshaft, a connecting rod or pitman operatively connected to said crankshaft by adjustable tapered roller berings and to said second die support by adjustable tapered roller bearings to move a die carried thereby to and from a die carried by said stationary die support upon rotation of said crankshaft.

2. A forging machine comprising a stationary frame, a first die support incorporated in or fixed with respect to said frame, second die support supported in said frame by linear-type ball bearings for movement towards and from said first die support, a crankshaft rotatably supported in said frame by adjustable tapered roller bearings, means for rotating said crankshaft, a connecting rod or pitman operatively to said crankshaft by adjustable tapered roller bearings, and means including adjustable tapered roller bearing connecting said pitman to said second die support to move a die carried thereby to and from a die carried by said first die support upon rotation of said crankshaft.

3. A forging machine comprising a stationary frame, a first die amount connected to said frame, a second die support supported in said frame on a plurality of cylindrical ways by sleeve linear ball bearings for movement towards and from said first die support, a crankshaft rotatably supported in said frame by adjustable tapered roller bearings, a connecting rod or pitman operatively connected to said crankshaft by adjustable tapered roller bearings, means including adjustable tapered roller bearings connecting said pitman to said second die support to move a die carried thereby towards and from a die carried by said first die support upon rotation of said crankshaft, and means for rotating said crankshaft.

4. A forging machine comprising a stationary frame, a first die support connected to said frame, a second die support supported by said frame on a plurality of cylindrical ways by sleeve like linear bal bearings for movement towards and from said first die support, a crankshaft rotatably supported by adjustable tapered roller bearings in said frame, a crosshead or ram supported in said frame for linear reciprocation, a connecting rod or pitman operatively connected to said crankshaft by adjustable tapered roller bearings, adjustable tapered roller bearings connected said pitman to said crosshead or ram, means connected said ram to said second die support to move a die carried towards and from a die carried by said first die support upon rotation of said crankshaft, and means for rotating said crankshaft.

5. A forging machine as claimed in claim 3 wherein said first and second die supports, said cylindrical ways and said means connecting said ram to said second die support are removable as a unit from said frame.

6. A forging machine comprising a stationary frame, a stationary die support incorporated in or fixed with respect to said frame for supporting two discrete forging dies facing in opposite directions, a movable die support supported by said frame at each opposite side of said stationary die support for movement towards and from said stationary die support and adapted for supporting discrete forging dies complementary to dies connected to said stationary die support, a crankshaft rotatably supported in said frame by adjustable tapered roller bearings, means for rotating said crankshaft, a crosshead or ram supported in said frame for linear reciprocation, a connecting rod or pitman operatively connected to both said crankshaft and to said ram by adjustable tapered roller bearings, means connecting said crosshead or ram to said movable die supports to move dies carried thereby altenatively to and from complimentary dies carried by said stationary die support upon rotation of said crankshaft whereby a forgoing or dieing operation is performable upon each 180° rotation of said crankshaft.

7. A forging machine comprising a stationary frame for supporting two discrete forging die facing in opposite directions, means for movably supporting discrete forging dies complementary to the stationary dies, a crankshaft rotatably supported in said frame by adjustable tapered roller bearings, means for rotating said crankshaft, and a connecting rod or pitman operatively connected to said crankshaft and to said means for movably supporting the complementary dies by adjustable tapered roller bearings for moving the complementary dies to and from the stationary dies upon rotation of said crankshaft whereby a forging or dieing operation is performable upon each 180° rotation of said crankshaft.

8. A forging machine comprising a stationary frame, a stationary die support incorporated in or fixed with respect to said frame for supporting two discrete forging dies facing in opposite directions, a movable die support carried by said frame at each opposite side of said stationary die support for movement towards and from said stationary die support and adapted for supporting discrete forging dies complementary to stationary dies carried by said stationary die support, a crankshaft rotatably supported in said frame by adjustable tapered roller bearings, and a connecting rod or pitman operatively connected to both said crankshaft and to said movable die supports by adjustable tapered roller bearings to move dies carried thereby alternately to and from complementary dies carried by said stationary die support upon rotation of said crankshaft whereby a forging or dieing operation is performable upon each 180° rotation of said crankshaft.

9. A forging machine comprising a stationary frame, a stationary die support incorporated in or fixed with respect to said frame for supporting two discrete forging dies facing in opposite directions, a movable die support at each opposite side of said stationary die support for supporting discrete forging dies complementary to stationary dies carried by said stationary die support, a plurality of cylindrical ways upon which said movable die supports are supported by linar ball bearings for movement towards and from said stationary die support, a crankshaft rotatably supported in said frame by adjustable tapered roller bearings, means for rotating said crankshaft, and a connecting rod or pitman operatively connected to both said crankshaft and to said movable die supports by adjustable tapered roller bearings to move alternate dies carried by said movable die supports to and from complementary dies carried by said stationary die support upon rotation of said crankshaft whereby a forging or dieing operation is performable upon each 180° rotation of said crankshaft.

10. A forging machine comprising a stationary frame, a stationary die support connected to said frame for supporting two discrete forging dies facing in opposite directions, a plurality of cylindrical ways connected to said frame, a movable die support at each opposite side of said stationary die support for supporting discrete forging dies complementary to the stationary dies supported on said cylindrical ways by sleeve type linear ball bearings, a crankshaft rotatably supported in said frame by adjustable tapered roller bearings, means for rotating said crankshaft, a crosshead or ram supported in said frame by adjustable ways for linear reciprocation, a connecting rod or pitman operatively connected to both said crankshaft and to said crosshead or ram by adjustable tapered roller bearings, discrete adjustable means connecting said crosshead or ram to said movable die supports to move dies carried thereby alternatively to and from complementary dies carried by said stationary die support upon rotation of said crankshaft whereby a forging or dieing operations is performable upon each 180° rotation of said crankshaft.

11. A forging machine as claimed in claim 10 wherein said die supports, said cylindrical ways and said adjustable means connecting said crosshead or ram to said movable die supports are removable as a unit from said frame.

* * * * *